United States Patent [19]

Tabei

[11] Patent Number: 4,799,038

[45] Date of Patent: Jan. 17, 1989

[54] SNAP-ACTION HEAT RESPONSIVE DEVICE

[75] Inventor: Shigeru Tabei, Tokyo, Japan

[73] Assignee: Tobu Electric Co., Ltd., Tokyo, Japan

[21] Appl. No.: 68,076

[22] Filed: Jun. 29, 1987

[30] Foreign Application Priority Data

Jul. 4, 1986 [JP] Japan ..... 61-157532

[51] Int. Cl.[4] ..... H01H 61/06

[52] U.S. Cl. ..... 337/379; 337/343; 337/365

[58] Field of Search ..... 428/616–619; 337/343, 365, 367, 379, 111, 372, 373, 374, 375

[56] References Cited

U.S. PATENT DOCUMENTS

| | | | |
|---|---|---|---|
| 2,496,746 | 2/1950 | Opperman | 337/343 |
| 2,531,115 | 11/1950 | Doak | 337/379 |
| 2,558,219 | 6/1951 | Kohl | 337/343 |
| 2,683,789 | 7/1954 | Ray et al. | 337/374 |
| 2,786,171 | 3/1957 | Clark | 337/365 |
| 3,130,585 | 4/1964 | Koci | 337/343 |
| 3,170,998 | 2/1965 | Stahl | 337/342 |
| 3,471,819 | 10/1969 | Gianola et al. | 337/365 |
| 3,821,679 | 6/1974 | Summe et al. | 337/343 |
| 4,151,383 | 4/1979 | Miyata | 337/343 |
| 4,159,155 | 6/1979 | Heydnev | 337/111 |

*Primary Examiner*—John J. Zimmerman

*Attorney, Agent, or Firm*—Jordan and Hamburg

[57] ABSTRACT

This invention provides a snap-action heat responsive device employing a bimetallic strip which is typically used with a thermostat, a temperature-protecting apparatus or the like. Two elongated portions of the bimetallic strip oppose each other so that they may be deflected in the opposite directions to double the amount of displacement of the bimetallic strip and in addition so that they may be urged in the opposite directions. This enables swift reverse of the bimetallic strip and also production of a small-sized bimetallic device suitable for use as a miniature current limiter for handling an electric current of about one ampere. It is therefore possible to produce a snap-action heat responsive device having a high sensitivity with respect to variations in temperature.

33 Claims, 8 Drawing Sheets

(A)

(B)

(C)

(D)

(A)

(B)

(A)

(B)

(C)

(D)

(A)

(B)

(C)

(D)

(F)

(E)

SNAP-ACTION HEAT RESPONSIVE DEVICE

BACKGROUND OF THE INVENTION

1. Field of the Prior Art

The present invention relates to a snap-action heat responsive device incorporating a bimetallic strip which is adapted for use with a thermostat, a temperature-protecting device or the like.

2. Description of the Prior Art

A conventional type of heat responsive device employing a bimetallic strip is previously disclosed in Japanese Patent Publication No. 32945/1979 and Japanese Utility Model Laid-open No. 160445/1983. In general, the heat responsive device of the prior art includes a bimetallic strip consisting of two strips each having a concave shape in cross section. Although it is relatively easy to work a large-sized bimetallic strip having such a concave shape, there is a problem in that, as a bimetallic strip to be worked is reduced in size, it becomes difficult to form a concave shape with high precision. This may lead to a problem in that the prior-art thermostat employing a bimetallic strip having a concave cross-sectional shape is unavoidably increased in size due to limitations imposed on its structure.

In addition, it is difficult to apply such a bimetallic strip having a concave cross-sectional shape to a heat responsive device of the type used as a small-sized current limiter or the like which is attached, for example, to a printed circuit board for the purpose of handling an electric current of about one ampere.

SUMMARY OF THE INVENTION

It is therefore an object of the present invention to provide a snap-action heat responsive device which exibits a high sensitivity with respect to variations in temperature and the size of which can be reduced to that suitable for use as a small-sized current limiter or the like for handling an electric current of about one ampere.

The aforementioned object is achieved by the present invention providing a snap-action heat responsive device comprising a bimetallic strip and a stretcher, the bimetallic strip having two elongated portions arranged with a space therebetween and in opposition to each other so that the elongated portions may be deflected in the opposite directions to each other and the stretcher having a size slightly larger than the aforesaid space and rotatably fitted into the two elongated portions. The two elongated portions of the bimetallic strip oppose each other so that they may be deflected in the opposite directions to double the amount of displacement of the bimetallic strip and in addition so that they may be urged in the opposite directions. This enables swift reverse of the bimetallic strip and also production of a small-sized bimetallic device suitable for use as a miniature current limiter for handling an electric current of about one ampere. Accordingly, the snap-action heat responsive device of the present invention is applicable to a thermostat of the general type used for domestic electrical appliances, motor protectors or the like. In addition, since the inventive device can be reduced in size and its performance has improvements over that of the prior-art device, it can find a variety of uses.

Further objects, features and advantages of the present invention will become apparent from the following description with reference to the accompanying drawings in which preferred embodiments of the present invention are diagrammatically shown.

DESCRIPTION OF THE PREFERRED EMBODIMENTS

Preferred embodiments of a snap-action heat responsive device of the present invention will be described below with reference to the accompanying drawings.

(First Embodiment)

Figure 1:
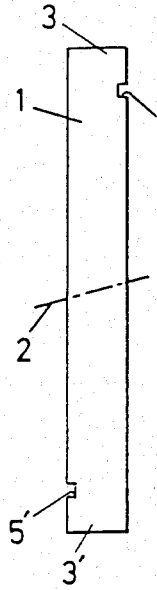
FIG. 1(A) is a front elevation of a first preferred embodiment of the present invention and showing a bimetallic strip which is not bent.
FIG. 1(B) is a side elevation of the first preferred embodiment shown in FIG. 1(A)
FIG. 1(C) is a front elevation of a stretcher used in the first preferred embodiment.
FIG. 1(D) is a side elevation of the stretcher shown in FIG. 1(C)
Figure 1:
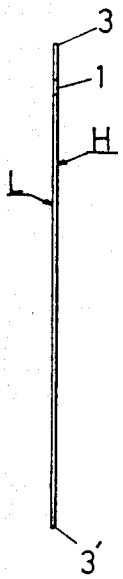
Figure 1:
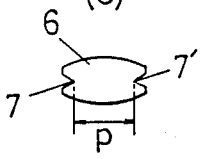
Figure 1:
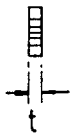

Referring to FIGS. 1(A) to 6(C), an elongated bimetallic strip is indicated at 1 and its longitudinal axis extends vertically as viewed, for example, in FIG. 1(A). A hypothetical reference line 2 along which the bimetallic strip 1 is bent is formed about the substantially central portion of the bimetallic strip 1, and the hypothetical referenece line 2 is inclined with respect to a line normal to the longitudinal axis of the bimetallic strip 1. The bimetallic strip 1 is bent such that opposite ends 3 and 3' thereof oppose each other but are offset from each other in the lateral direction as viewed in FIG. 2(A). The bimetallic strip 1 consists of two strips of metal, one strip "H" having a large coefficient of thermal expansion while the other strip "L" has a small coefficient of thermal expansion. When the bimetallic strip 1 is bent, the former strip "H" constitutes the outer side thereof with the latter strip "L" constituting the inner side thereof. As shown, substantially U-shaped cutouts 5 and 5' are in advance formed in the peripheral edge of the bimetallic strip 1. When the bimetallic strip 1 is bent in this manner, two inner edges 4 and 4' of the bimetallic strip 1 oppose each other with the cutouts 5 and 5' facing each other.

Referring to FIGS. 1(C) and 1(D), a stretcher indicated at 6 has wedge-shaped cutouts 7 and 7' at its opposite ends. The stretcher 6 is preferably formed of relatively hard metal such as phoshor bronze, german silver, iron, stainless steel or a ceramic material, and has a thickness t as shown in FIG. 1(D). Each of the U-shaped cutouts 5 and 5' has a width a as shown shown in FIG. 2(A), and the thickness t of the stretcher 6 is slightly smaller than the width a, that is, the thickness t is determined such that $a>t$. A distance p between the opposite bottoms of the wedge-shaped cutouts 7 and 7' of the stretcher 6 is somewhat greater than a distance b between the bottoms of the U-shaped cutouts 5 and 5' of the bimetallic strip 1, that is, the former distance p is determined such that $p>b$.

The thus-formed stretcher 6 is attached to the bimetallic strip 1 by engaging the wedge-shaped cutouts 7 of the former with the U-shaped cutouts 5 and 5' of the latter. Thus, the space between the opposite ends 3 and 3' of the bimetallic strip 1 which is bent is enlarged as shown in FIGS. 3(A) to 3(C). The distance b between the bottoms of the U-shaped cutouts 5 and 5' thereby becomes equal to the distance p between the bottoms of the wedge-shaped cutout 7 and 7' of the stretcher 6, that is, b=p is established and the state shown in FIG. 3(C) is obtained. In this case, the bimetallic strip 1 is bent such that the strip "H" with a large coefficient of thermal expansion may constitute the outer side thereof while the other strip "L" with a low coefficient of thermal expansion constitutes the inner side of the same. Accordingly, as shown in FIG. 3(C), the opposite ends 3 and 3' of the bimetallic strip 1 respectively tend to move in the directions indicated by arrows n and n' in accordance with a rise in temperature.

Figure 3:
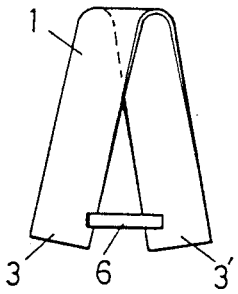
FIG. 3(A) is a front elevation of the first preferred embodiment but showing a state wherein the stretcher is engaged with the bimetallic strip which is bent.
FIG. 3(B) is a side elevation of the bimetallic strip with the stretcher shown in FIG. 3(A)
FIG. 3(C) is a bottom view of the bimetallic strip with the stretcher shown in FIG. 3(A)
Figure 3:
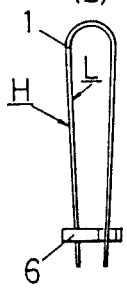
Figure 2:
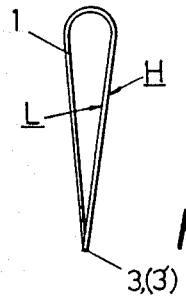
FIG. 2(A) is a front elevation of the first preferred embodiment of the present invention but showing the bimetallic strip which is bent.
FIG. 2(B) is a side elevation of the first preferred embodiment shown in FIG. 2(A)
FIG. 2(C) is a bottom view of the first preferred embodiment shown in FIG. 2(A)
Figure 2:
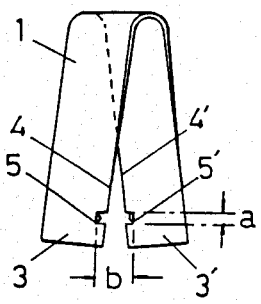
Figure 3:
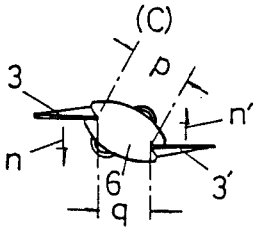
Figure 2:
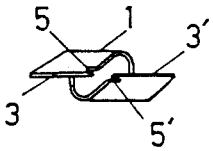
Figure 4:
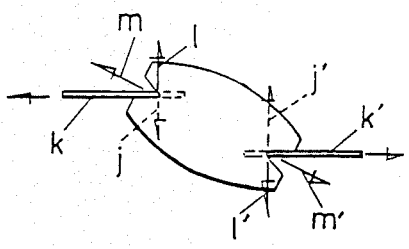
FIG. 4 is a view used as an aid in explaining the relationship between tensile forces acting on the bimetallic strip constituting the first embodiment.

In this state, the bimetallic strip 1 is deformed such that the distance b between the bottoms of the U-shaped cutouts 5 and 5' is enlarged up to a distance q by the motion of the stretcher 6. As shown in FIG. 4, tensile forces m and m' respectively act on the U-shaped cutouts 5 and 5'. The tensile forces m and m' are divided in the vertical and horizontal directions as shown in FIG. 4, and act on the bimetallic strip 1 in the form of vertical component forces l, l' and horizontal component forces k, k'. If temperature rises in this state, the opposite ends 3 and 3' of the bimetallic strip 1 respectively tend to move in the directions indicated by the arrows n and n' as shown in FIG. 3(C). However, since the aforesaid vertical component forces 1 and 1' act on the bimetallic strip 1 as shown in FIG. 4, the opposite ends 3 and 3' are not allowed to easily move in such directions. On the other hand, as temperature rises, the U-shaped cutouts 5 and 5' in the bimetallic strip 1 respectively act in the direction of the arrows n and n', thereby urging the opposite ends 3 and 3' of the bimetallic strip 1 in the same directions, respectively. In consequence, bimetallic tensile forces j and j' act on the bimetallic strip 1 in the directions of arrows shown by dotted lines in FIG. 4. Subsequently, as this temperature rise further continues, the bimetallic tensile forces j and j' respectively overcome the vertical component forces l and l'.

Figure 5:
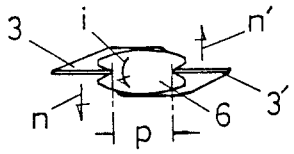
FIG. 5 is a bottom view used as an aid in explaining a state wherein the amount of deformation of the bimetallic strip reaches a dead point owing to a variation in ambient temperature.
Figure 6:
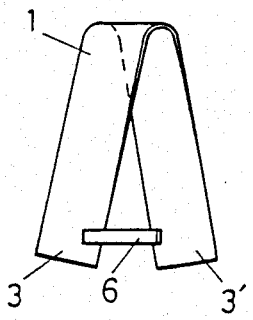
FIG. 6(A) is a front elevation of the first preferred embodiment but showing the bimetallic strip which has completed its swift reverse owing to a variation in ambient temperature.
FIG. 6(B) is a side elevation of the first embodiment shown in FIG. 6(A)
FIG. 6(C) is a bottom view of the first embodiment shown in FIG. 6(C)
Figure 6:
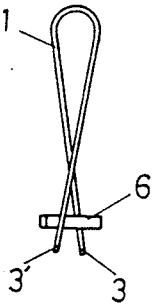
Figure 6:
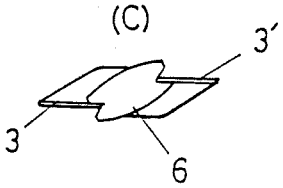
Figure 7:
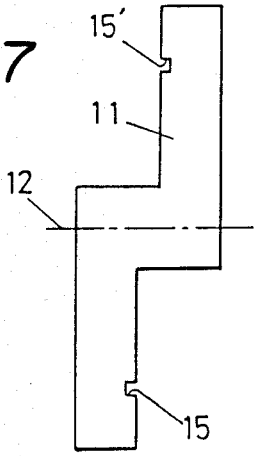
FIG. 7(A) is a front elevation of a second preferred embodiment of the present invention and showing a bimetallic strip which is not bent.
FIG. 7(B) is a side elevation of the second preferred embodiment shown in FIG. 7(A)
Figure 7:
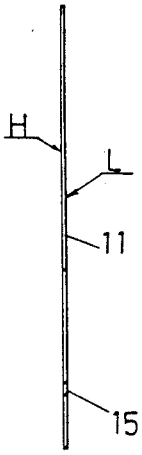
Figure 8:
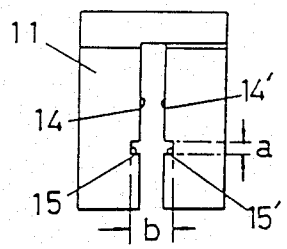
FIG. 8(A) is a front elevation of the second preferred embodiment of the present invention but showing the bimetallic strip which is bent.
FIG. 8(B) is a side elevation of the second preferred embodiment shown in FIG. 8(A)
FIG. 8(C) is a bottom view of the second preferred embodiment shown in FIG. 8(A)
Figure 8:
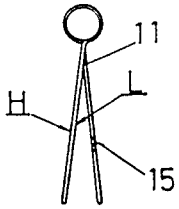
Figure 8:
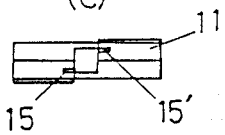
Figure 9:
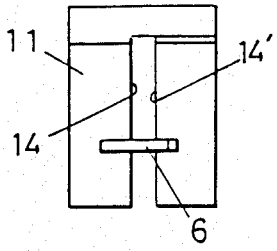
FIG. 9(A) is a front elevation of the second preferred embodiment but showing a state wherein a stretcher is engaged with the bimetallic strip which is bent.
FIG. 9(B) is a side elevation of the bimetallic strip with the stretcher shown in FIG. 9(A)
FIG. 9(C) is a bottom view of the bimetallic strip with the stretcher shown in FIG. 9(A)
Figure 9:
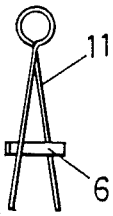
Figure 9:
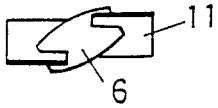
Figure 10:
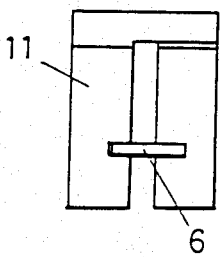
FIG. 10(A) is a front elevation of the second preferred embodiment but showing the bimetallic strip which has completed its swift reverse owing to a variation in ambient temperature.
FIG. 10(B) is a side elevation of the second embodiment shown in FIG. 10(A)
FIG. 10(C) is a bottom view of the second embodiment shown in FIG. 10(C)
Figure 10:
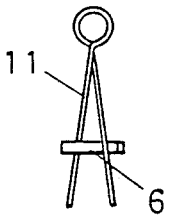
Figure 10:
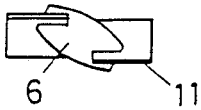

In this state, the opposite ends 3 and 3' of the bimetallic strip 1 starts to move, and are aligned with each other in the lateral direction as viewed in FIG. 5. In this case, the distance b between the bottoms of the U-shaped cutouts 5 and 5' exceeds the aforesaid distance q shown in FIG. 3(C), and increases up to the distance p between the bottoms of the wedge-shaped cutouts 7 and 7' in the stretcher 6. However, after the bimetallic strip 1 has passed the aforementioned laterally aligned state, the distance b starts to decrease. In other words, a position at which the opposite ends 3 and 3' of the bimetallic strip 1 are aligned with each other in the lateral direction as shown in FIG. 5 is a "dead point". Immediately after the dead point has been exceeded, the respective opposite ends 3 and 3' are swiftly moved in the directions of the arrows n and n' shown in FIG. 5. Simultaneously, the stretcher 6 is rotated in the direction indicated by an arrow i and is swiftly reversed to a position as shown in FIG. 6. In other words, the positional relationship between the opposite ends 3 and 3' shown in FIG. 3 is swiftly reversed to a reverse positional relationship as shown in FIG. 6.

It will be appreciated that the aforesaid function is likewise achieved in another case where the bimetallic strip 1 is bent such that one strip thereof with a large coefficient of thermal expansion may constitute the inner side thereof while the other strip with a small coefficient of thermal expansion constitutes the outer side of the same.

(Second Embodiment)

The second embodiment shown in FIGS. 7(A) to 10(C) differs from the aforesaid first embodiment only in that a bimetallic strip 11 has a crank-shaped form, but they are substantially the same in the other respects.

More specifically, a hypothetical reference line 12 along which the bimetallic strip 11 is bent is formed about the substantially central portion of the bimetallic strip 11 having such a crank-like shape as shown in FIGS. 7(A) to 10(C) A. The hypothetical reference line 12 is extended in the direction normal to the longitudinal axis of the bimetallic strip 11. The bimetallic strip 11 is bent in a manner as shown, for example, in FIGS. 8(A) and 8(B).

When the bimetallic strip 11 is bent, it is formed in a U-like shape in front elevation and one strip "H" having a large coefficient of thermal expansion constitutes the outer side of the bimetallic strip 11 with the other strip "L" having a small coefficient of thermal expansion constituting the inner side of the same. As shown, substantially U-shaped cutouts 15 and 15' are in advance formed in the peripheral edge of the bimetallic strip 11. When the bimetallic strip 1 is bent in this manner, two inner edges 14 and 14' of the bimetallic strip 11 oppose each other with the cutouts 15 and 15' also facing each other.

The stretcher 6 shown in FIGS. 1(C) and 1(D) is engaged with the U-shaped cutouts 15 and 15' of the thus-formed bimetallic strip 11 in the manner shown in FIGS. 9(A) to 9(C). The operation of the bimetallic strip 11 and the tensile forces acting thereon during temperature rise are completely the same as in the case of the first embodiment, and therefore, the description is omitted.

It is to be noted that the bimetallic strip 11 finally is swiftly reversed to the reverse position shown in FIGS. 10(A) to 10(C).

It will be appreciated that the aforesaid function is likewise achieved in another case where the bimetallic strip 11 is bent such that one strip thereof with a large coefficient of thermal expansion may constitute the inner side thereof while the other strip with a small coefficient of thermal expansion constitutes the outer side of the same.

(Third Embodiment)

Figure 11:
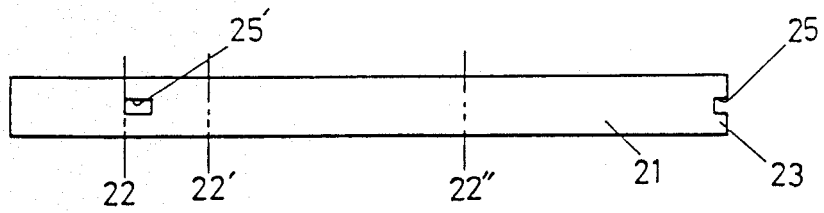
FIG. 11(A) is a front elevation of a third preferred embodiment of the present invention and showing a bimetallic strip which is not bent.
FIG. 11(B) is a front elevation of the third preferred embodiment but showing a state wherein a stretcher is engaged with the bimetallic strip which is bent.
FIG. 11(C) is a front elevation illustrating a state wherein the amount of deformation of the bimetallic strip reaches a dead point owing to a variation in ambient temperature.
FIG. 11(D) is a front elevation of the third preferred embodiment but showing the bimetallic strip which has completed its swift reverse owing to a variation in ambient temperature.
Figure 11:
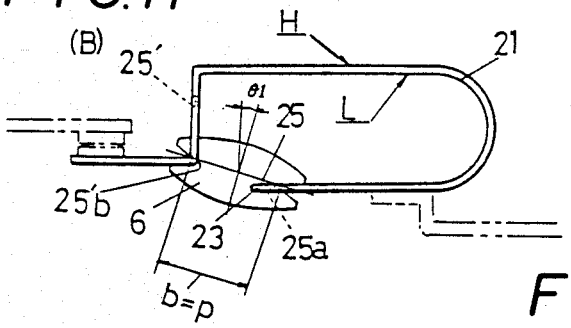
Figure 11:
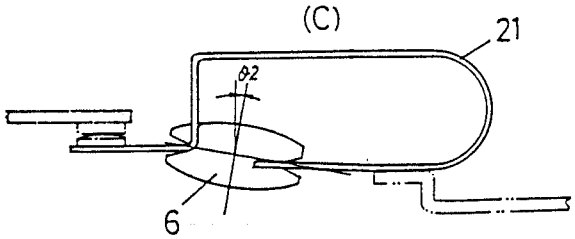
Figure 11:
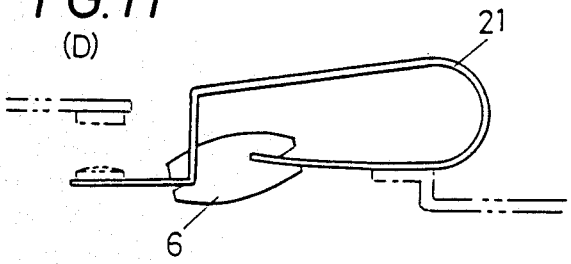

In the third embodiment shown in FIGS. 11(A) to 11(D), a bimetallic strip extends in the lateral direction as viewed in FIG. 11(A). Two hypothetical reference lines 22 and 22' along which the bimetallic strip 21 is bent are formed on the bimetallic strip 21 such that they extend in the direction normal to the longitudinal axis of the same. The bimetallic strip 21 is bent in a manner as shown, for example, in FIG. 11(B).

When the bimetallic strip 21 is bent, one strip "H" having a large coefficient of thermal expansion constitutes the outer side of the bimetallic strip 21 with the other strip "L" having a small coefficient of thermal expansion constituting the inner side of the same. A substantially U-shaped cutout 25 is formed in one edge 23 of the bimetallic strip 21, and an aperture 25' is formed in a portion of the bimetallic strip 21 corresponding to the reference line 22, the portion opposing the U-shaped cutout 25 when the bimetallic strip 21 is bent.

The distance b between respective opposing edges 25*a* and 25*b*' of the cutout 25 and the aperture 25' is smaller than the distance p between the bottoms of the wedge-shaped cutouts 7 and 7' formed in the stretcher 6 shown in FIGS. 1(C) and 1(D). When the stretcher 6 is engaged with the cutout 25 and the aperture 25', b=p is established and thus a tensile force is produced between the respective opposing edges 25*a* and 25*b*' of the cutout 25 and the aperture 25'.

Subsequently, as the temperature of the bimetallic strip 21 rises, the bimetallic strip 21 is deformed to the state shown in FIG. 11(C) by the rotary motion of the stretcher 6 so that an angle $\theta 1$ is reduced to an angle $\theta 2$. Thereafter, as soon as the dead point is passed, the stretcher 6 is swiftly reversed to the position shown in FIG. 11(D).

Figure 12:
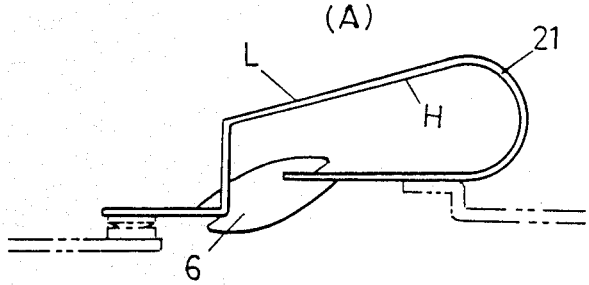
FIG. 12(A) is a front elevation of a modification of the third embodiment.
FIG. 12(B) is a front elevation similar to FIG. 12(A) but showing another modification of the third embodiment.
Figure 12:
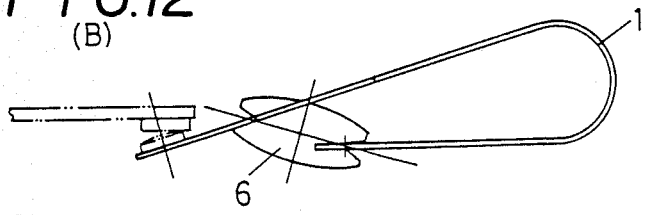
Figure 13:
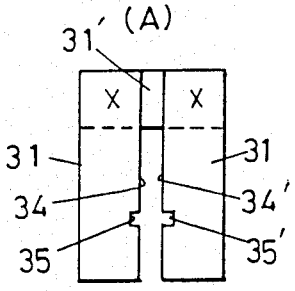
FIG. 13(A) is a front elevation of a fourth preferred embodiment of the bimetallic strip of the present invention.
FIG. 13(B) is a front elevation of the fourth embodiment but showing the state wherein a stretcher is engaged with the bimetallic strip.
FIG. 13(C) is a side elevation of the fourth embodiment shown in FIG. 13(B)
FIG. 13(D) is a bottom of the fourth embodiment shown in FIG. 13(B)
Figure 13:
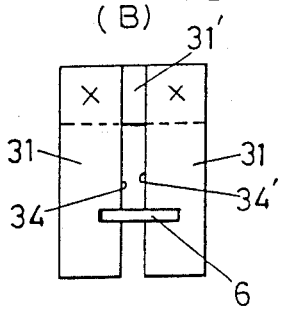
Figure 13:
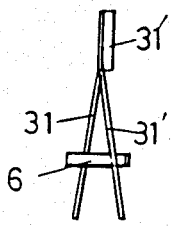
Figure 13:
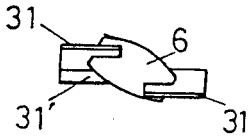
Figure 14:
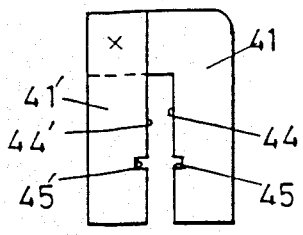
FIG. 14(A) is a front elevation of a fifth preferred embodiment of the bimetallic strip of the present invention.
FIG. 14(B) is a front elevation of the fifth embodiment but showing the state wherein a stretcher is engaged with the bimetallic strip.
FIG. 14(C) is a side elevation of the fifth embodiment shown in FIG. 14(B)
FIG. 14(D) is a bottom view of the fifth embodiment shown in FIG. 14(B)
Figure 14:
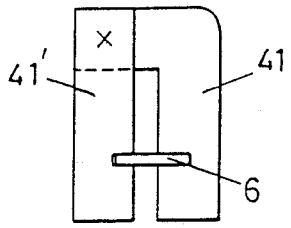
Figure 14:
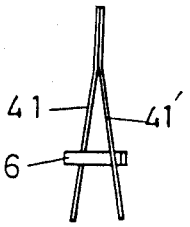
Figure 14:
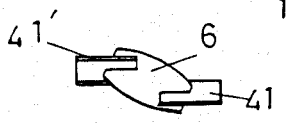

It will be appreciated that the aforesaid function is likewise achieved in another case where, as shown in FIG. 12(A), the bimetallic strip 21 is bent such that one strip "H" thereof with a large coefficient of thermal expansion may constitute the inner side thereof while the other strip "L" with a small coefficient of thermal expansion constitutes the outer side of the same. In addition, even when, as shown in FIG. 12(B), the portions corresponding to the reference lines 22 and 22' are eliminated and such portions are worked in a straight form, it is possible to achieve the same effect.

(Fourth Embodiment)

In the fourth embodiment shown in FIGS. 13(A) to 13(D), each of two bimetallic strips 31 has one end secured to a non-bimetallic member 31' such that the resultant bimetallic device as a whole is formed in a subtantially U-like shape. Substantially U-shaped cutouts 35 and 35, respectively, are formed in opposing inner edges 34 and 34' of the respective bimetallic strips 31, and the aforesaid stretcher 6 is engaged with the cutouts 35 and 35'. Since this embodiment is the same as the second embodiment in the other respects, the description is omitted.

(Fifth Embodiment)

In the fifth embodiment shown in FIGS. 14(A) to 14(D), a bimetallic strip 41 formed in a substantially L-like shape is secured to a non-bimetallic member 41', thereby obtaining a bimetallic device having a substantially U-like shape as a whole. Substantially U-like shaped cutouts 45 and 45' are respectively formed in face-to-face relationship in opposing inner edges 44 and 44' formed in the bimetallic strip 41 and the non-bimetallic member 41', and the aforesaid stretcher 6 is engaged with the thus-obtained cutouts 45 and 45'. Since this embodiment is also the same as the second embodiment in the other respects, the description is omitted.

(Other Embodiments)

Figure 15:
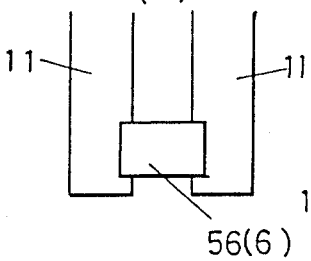
FIG. 15(A) is a front elevation of another example of the stretcher used in the present invention.
FIG. 15(B) is a bottom view of the stretcher shown in FIG. 15(A)
FIG. 15(C) is a front elevation of another example of the stretcher used in the present invention.
FIG. 15(D) is a bottom view of the stretcher shown in FIG. 15(C)
FIG. 15(E) is a perspective view of another example of the stretcher used in the present invention.
FIG. 15(F) is a perspective view of one example of engagement between a bimetallic strip and the stretcher shown in FIG. 15(E)
FIG. 15(G) is a perspective view of another example of engagement between a bimetallic strip and the stretcher shown in FIG. 15(E)
Figure 15:
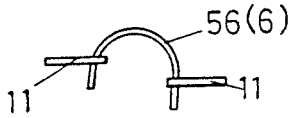
Figure 15:
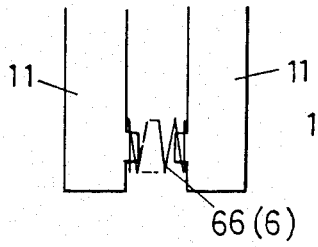
Figure 15:
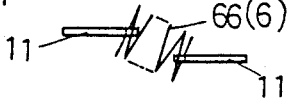
Figure 15:
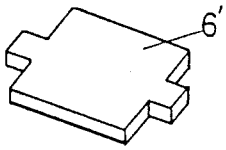
Figure 15:
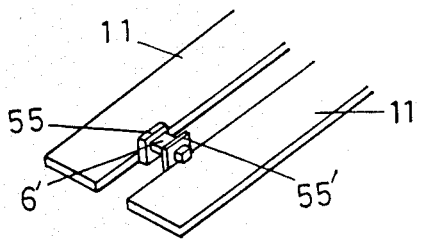
Figure 15:
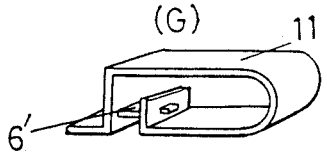

In the foregoing descriptions of the respective embodiments, the stretcher 6 is shaped as shown in FIGS. 1(C) and 1(D) by way of example. However, as shown in FIGS. 15(A) and 15(B), a leaf spring 56 may be employed, or a coiled spring 66 may be employed as shown in FIGS. 15(C) and 15(D). In either case, it is possible to achieve the same effect.

Also, the stretcher 6 can be attached in various manners. For example, the stretcher 6 is formed in the shape shown in FIG. 15(E), and, as shown in FIG. 15(F), a pair of folded portions 55 and 55' are partially formed on the inner opposing edges of the bimetallic strip 11 in an upright projecting manner. Holes are respectively formed in the folded portions 55 and 55', and the stretcher 6 may be engaged with the holes. In addition, a method as shown in FIG. 15(G) may also be utilized.

Figure 16:
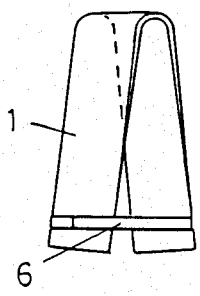
FIG. 16(A) is a front elevation of a further example of the stretcher used in present invention.
FIG. 16(B) is a bottom view of the stretcher shown in FIG. 16(A)
Figure 16:
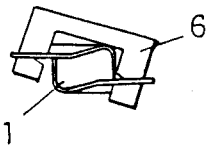

The respective embodiments and their modifications illustratively refer to an arrangement in which the stretcher 6 (the leaf spring 56 or the coiled spring 66) is engaged with the opposing inner edges of the bimetallic strip 1 (11, 21, 31 or 41). However, as shown in FIGS. 16(A) and 16(B), the stretcher 6 per se may be formed in a substantially U-like shape and engaged with the bimetallic strip 1 from the outside thereof. In this case, the U-shaped cutouts 5 and 5' are preferably formed in edges of the bimetallic strip 1 such that, when the strip 1 is bent, the respective edges having the cutouts 5 and 5' are located outside.

Figure 17:
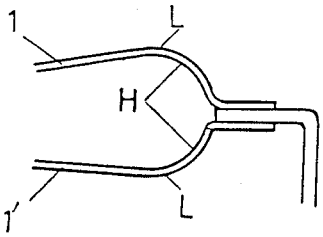
FIG. 17 is a front view showing in part one example of the bimetallic strip used in the present invention.

As illustratively described above in the first, second and third preferred embodiments, a single piece of the bimetallic strip 1 (11, 21) is bent at one portion thereof in an arcuated manner. However, the bimetallic strip 1 and a bimetallic strip 1' may be connected as shown in FIG. 17.

Figure 18:
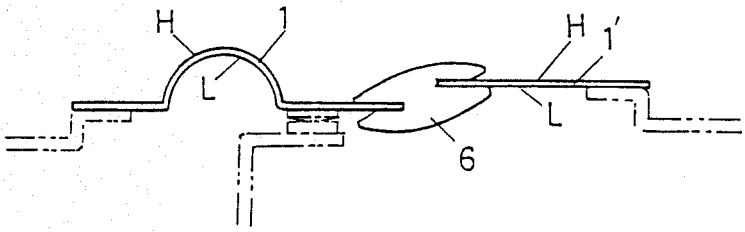
FIG. 18 is a front view showing in part another example of the bimetallic strip used in the present invention.

In addition, as shown in FIG. 18, the two bimetallic strips 1 and 1' may be constructed such that one end of the strip 1 opposes one end of the strip 1'.

Figure 19:
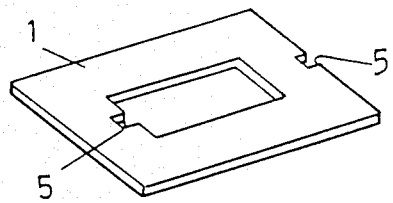
FIG. 19(A) is a perspective view of still another example of the bimetallic strip used in the present invention.
FIG. 19(B) is a front elevation showing a state wherein a stretcher is engaged with the bimetallic strip of FIG. 19(A) which is curved.
FIG. 19(C) is a front elevation of another example of the bimetallic strip having an S-shaped form.
FIG. 19(D) is a front elevation showing a state wherein a stretcher is engaged with the bimetallic strip of FIG. 19(C) which is curved.
FIG. 19(E) is a perspective view of an example of a square bimetallic strip having one side on which an elongated portion is formed.
FIG. 19(F) a front elevation showing a state wherein a stretcher is engaged with the bimetallic strip of FIG. 19(E) which is curved.
Figure 19:
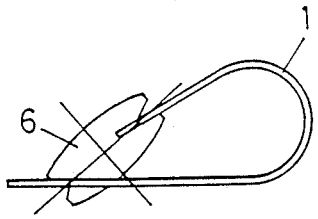
Figure 19:
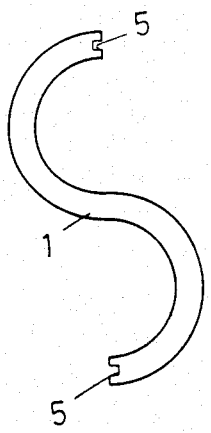
Figure 19:
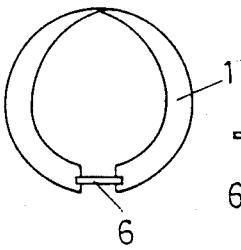
Figure 19:
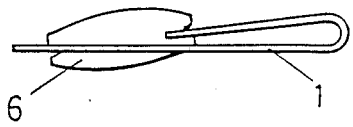
Figure 19:
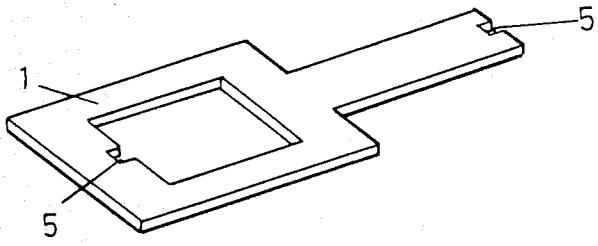

Also, the bimetallic strip 1 is formed so as to have a square form as shown in FIG. 19(A) and a square aperture is punched therein. The stretcher 6 may be engaged with the thus-obtained bimetallic strip 1 which is curved as shown in FIG. 19(B). In addition, it is preferred that, after the bimetallic strip 1 has been formed in an S-like shape as shown in FIG. 19(C), the stretcher 6 is engaged therewith as shown in FIG. 19(D). Moreover, it is also preferred that, after an elongated portion has been formed on one edge of the square bimetallic strip 1, the stretcher 6 is engaged therewith as shown in FIG. 19(F).

It is to be noted that, when the snap-action heat responsive device in accordance with the present invention is to be used with a thermostat or the like, one end of the bimetallic strip is secured to the thermostat body and the other end thereof is employed as a moving contact. In consequence, the amount of displacement of the moving contact can be made two times as large as that of a typical bimetallic strip.

As described above, the snap-action heat responsive device in accordance with the present invention incorporates a bimetallic strip having opposing ends capable of moving in the opposite directions to each other. This produces a bimetallic effect equivalent to twice as large as a typical coefficient at which the bimetallic strip is curved in accordance with a rise in temperature. Accordingly, it is possible to achieve a small-sized and high-sensitivity heat responsive device.

What is claimed is:

1. A snap-action temperature response device comprising a bimetallic strip having a generally flat unsprung state, said bimetallic strip having a central portion and two leg portions extending from said central portion, said two leg portions each having engaging means, said flat bimetallic strip being bent at said central portion to define a sprung unactuated state of said bimetallic strip in which said engaging means of each leg portion are spaced from one another, stretcher means in said space between said engageable means, said stretcher means having pivot-support means engaging and pivotally supporting said engaging means of said leg portions, said leg portions being pivotable at said pivot-support means from said sprung unactuated state to a sprung actuated state in response to a temperature change of said bimetallic strip.

2. A snap-action temperature response device comprising a bimetallic strip, said bimetallic strip having a sprung unactuated state in which the metallic strip is bent over on itself to form a bent portion and two elongated leg portions extending from said bent portion, each of said leg portions having engaging means which are spaced from one another when said bimetallic strip is in said sprung unactuated state, and a stretch in said space between each of said engaging means of said two leg portions, said stretcher having pivot-support means engaging and pivotably supporting said engaging means of each of said leg portions, said leg portions being pivotal at said pivot-support means from said sprung unactuated state to a sprung actuated state in response to a temperature change of said bimetallic strip.

3. A snap-action temperature response device according to claim 2 wherein said bimetallic strip comprises two joined metal strip elements, each of said metal strip elements being an integral strip of metal.

4. A snap-action temperature response device according to claim 2 wherein said bimetallic strip has a generally U-shaped configuration when in said unactuated sprung state.

5. A snap-action temperature response device according to claim 2 wherein said bent portion is bent about 180 degrees.

6. A snap-action temperature response device according to claim 2 wherein said bent portion is bent more than 180 degrees.

7. A snap-action temperature response device according to claim 2 wherein said leg portions are generally flat, said flat leg portions being spaced from one another in a direction generally parallel to the plane of said float leg portions when said bimetallic strip is in said sprung unactuated state.

8. A snap-action temperature response device according to claim 7 wherein said leg portions are movable in a direction generally perpendicular to said plane when said bimetallic strip is subjected to a temperature change.

9. A snap-action temperature response device according to claim 7 wherein said flat leg portions have lateral edges, at least one of said engaging means being located on one lateral edge of at least one of said leg portions.

10. A snap-action temperature response device according to claim 7 wherein said flat leg portions have lateral edges, said engaging means being located on said lateral edges.

11. A snap-action temperature response device according to claim 7 wherein said flat leg portions each have terminating ends, at least one of said terminating ends defining at least one of said engaging means.

12. A snap-action temperature response device according to claim 7 wherein at least one of said engaging means comprises opening means defining an opening in at least one of said leg portions, said opening having an edge engaged by one of said pivot-support means of said stretcher.

13. A snap-action temperature response device according to claim 7 wherein said engaging means comprises a bend in one of said leg portions, said bend being engaged by one of said piovt-support means of said stretcher.

14. A snap-action temperature response device according to claim 2 wherein said stretcher is biasingly retained in said space between said engaging means as said leg portions move between said sprung unactuated and actuated states, said stretcher having a central axis, said stretcher rotating about said central axis as said leg portions move between said sprung unactuated and actuated states.

15. A snap-action temperature response device according to claim 2 wherein said bimetallic strip has a generally U-shaped configuration when in said sprung unactuated state with said elongated leg portions constituting the legs of the U, said elongated leg portions crossing one another in an X-shaped configuration when in said sprung actuated state.

16. A snap-action temperature response device according to claim 2 wherein said bent portion has a generally cylindrical configuration, said cylindrically configured bent portion defining a cylindrical axis, said leg portions being spaced from one another along said axis.

17. A snap-action temperature response device according to claim 16 wherein said bimetallic strip when viewed from a direction perpendicular to said axis has a generally U-shaped configuration.

18. A snap-action temperature response device according to claim 16 wherein said leg portions when viewed from a direction parallel to said axis have a generally V-shaped configuration when in said sprung unactuated state.

19. A snap-action temperature response device according to claim 2 wherein one of said leg portions is longer than the other leg portion, said other leg portion having a terminating end, said one leg portion having at least one bend spaced from said terminating end, said terminating end and said bend constituting said engaging means which is engaged by said pivot-support means of said stretcher.

20. A snap-action temperature response device according to claim 2 wherein one of said leg portions is longer than the other leg portion, each of said leg portions having a terminating end, one of said engaging means being spaced from the terminating end of said one leg portion, said pivot-support means of said stretcher engaging said one engaging means and said terminating end of said other leg portion, said terminating end of said other leg portion constituting another one of said engaging means.

21. A snap-action temperature response device according to claim 20 wherein said one engaging means comprises an opening in said one leg portion.

22. A snap-action temperature response device according to claim 20 wherein said one engaging means comprises a bend in said one leg portion.

23. A snap-action temperature response device according to claim 2 wherein said bimetallic strip has an unsprung configuration when in its natural and unsprung state prior to being assembled with said stretcher to said sprung unactuated state, said unsprung configuration being generally S-shaped, said bimetallic strip in its sprung unactuated state having a generally O-shaped configuration.

24. A snap-action temperature response device according to claim 23 wherein said bimetallic strip has an unsprung configuration when in its natural and unsprung state prior to being assembled with said stretcher to said sprung unactuated state, said unsprung configuration being in the form of a generally flat strip having an enclosed opening, said opening having an inner edge which defines a part of the boundary of said opening, said flat strip having an outer edge which defines a part of the outer boundary of said flat strip, said pivot-support means of said stretcher engaging said inner and outer edges when said bimetallic metal strip is in said sprung unactuated state, said inner and outer edges constituting said engaging means.

25. A snap-action temperature response device according to claim 23 wherein said bimetallic strip has an unsprung configuration when in its natural and unsprung state prior to being assembled with said stretcher to said sprung unactuated state, said unsprung configuration being a generally flat strip having a rectangular section and an extending section extending from said rectangular section, said rectangular section having an enclosed opening, said opening having an inner edge which defines a part of the boundary of said opening, said extending section having a terminating outer edge, said pivot-support means of said stretcher engaging said inner and outer edges when said bimetallic strip is in said sprung unactuated state, said inner and outer edges constituting said engaging means.

26. A snap-action temperature response device according to claim 2, wherein said stretcher is biasingly retained in said space between said engaging means of said leg portions when said leg portions are in said sprung unactuated state, when said leg portions are in said sprung actuated state, and when said leg portions are being pivoted between said sprung unactuated state and said sprung actuated state.

27. A snap-action temperature response device according to claim 2 wherein electrical contact means are provided on each of said leg portions.

28. A snap-action heat responsive device comprising a bimetallic strip, said bimetallic strip being bent over on itself to form a bent intermediate portion and two leg portions on opposite sides of said intermediate portion, said two leg portions being generally flat, at least one of said flat leg portions being movable generally perpendicular to the plane of said one flat leg portion, and a stretcher between said two flat leg portions and operable to dispose said one flat leg portion in a sprung unactuated state, said stretcher and said intermediate portion cooperating to provide a biasing force to biasingly retain said one flat leg portion in said sprung unactuated state, said one flat leg portion being movable in a direction in a plane perpendicular to said one flat leg portion in response to temperature change to overcome said biasing force to move said one flat leg portion to a sprung actuated state spaced from said sprung unactuated state, said stretcher and said intermediate portion cooperating to provide a biasing force to biasingly retain said one flat leg portion in said sprung actuated state.

29. A snap-action heat responsive device according to claim 28 wherein said stretcher is made of a physically non-resilient material.

30. A snap-action heat responsive device according to claim 28 wherein said stretcher is made of physically resilient material.

31. A snap-action heat responsive device according to claim 28 wherein said stretcher has a generally U-shaped configuration.

32. A snap-action head responsive device according to claim 28 wherein said stretcher is made of electrically conductive material.

33. A snap-action heat responsive device according to claim 28 wherein said stretcher is made of electrically non-conductive material.

* * * * *